US007048165B2

(12) United States Patent
Haramiishi

(10) Patent No.: US 7,048,165 B2
(45) Date of Patent: May 23, 2006

(54) STAPLE DETECTING MECHANISM OF ELECTRIC STAPLER

(75) Inventor: Kiichi Haramiishi, Tokyo (JP)

(73) Assignee: MAX Co., Ltd., Tokyo (JP)

( * ) Notice: Subject to any disclaimer, the term of this patent is extended or adjusted under 35 U.S.C. 154(b) by 0 days.

(21) Appl. No.: 10/488,986

(22) PCT Filed: Sep. 10, 2002

(86) PCT No.: PCT/JP02/09209

§ 371 (c)(1),
(2), (4) Date: Mar. 9, 2004

(87) PCT Pub. No.: WO03/022538

PCT Pub. Date: Mar. 20, 2003

(65) Prior Publication Data

US 2004/0245307 A1 Dec. 9, 2004

(30) Foreign Application Priority Data

Sep. 10, 2001 (JP) ..... 2001-273328

(51) Int. Cl.
*B27F 7/17* (2006.01)

(52) U.S. Cl. ..... 227/3; 227/136

(58) Field of Classification Search ..... 227/3, 227/5, 120, 129, 4, 131, 136
See application file for complete search history.

(56) References Cited

U.S. PATENT DOCUMENTS 4,623,082 A * 11/1986 Kurosawa ..... 227/7
5,346,114 A * 9/1994 Udagawa et al. ..... 227/120
5,702,047 A * 12/1997 Yoshie ..... 227/131
6,039,230 A * 3/2000 Yagi et al. ..... 227/120
6,050,471 A * 4/2000 Yagi ..... 227/119

FOREIGN PATENT DOCUMENTS

JP 3-33077 * 4/1991
JP 2001-171898 * 6/2001

* cited by examiner

*Primary Examiner*—Stephen F. Gerrity
*Assistant Examiner*—Paul Durand
(74) *Attorney, Agent, or Firm*—Chapman and Cutler LLP

(57) ABSTRACT

A staple sheet-detecting mechanism of an electric stapler having improved detection accuracy and miniaturization has a passage for feeding a staple sheet composed of straight forward staples arranged in parallel, and a forming plate and driver arranged above an anvil of the passage. A staple is inserted into papers located under the staple by moving the forming plate and the driver to a side of the staple. Above the anvil, where the forming plate waits, is a sensor (rocking member) of which one end contacts a tip edge of the staple sheet in a feeding direction, while the other end turns on or off an interrupter (detecting element). A rocking fulcrum of the sensor is provided biased to a side of the staple sheet in the passage. The forming plate and the driver are provided with recessed portions and, respectively, for allowing the sensor to rock.

3 Claims, 10 Drawing Sheets

STAPLE DETECTING MECHANISM OF ELECTRIC STAPLER

TECHNICAL FIELD

The present invention relates to a staple-detecting mechanism of an electric stapler. More particularly, the invention relates to a staple-detecting mechanism for detecting whether a staple sheet formed in a sheet-like shape is located at a forming position of a forming mechanism or not when a stapler is separated from the staple sheet and formed in a one side-open rectangular shape in binding copying papers.

PRIOR ART

Heretofore, there have been some stackers, etc. in copy machines and the like in which an electric stapler is arranged.

FIG. 16 shows an outlined construction of such an electric stapler 1. In this electric stapler 1, staple sheets 3 (See FIG. 17) each constituted by arranging numerous straight forward staples in parallel and bonding them in a sheet-like shape with an adhesive are used.

As shown in FIG. 16, the staple sheets 3 are stacked and stored in a cartridge 4. Every staple sheet 3 is fed from the cartridge 4 with a roller 5 such that one or more staples 2 come out every time.

The staples 2 located at a front edge as viewed in a feeding direction are each formed one by one in a one side-opened rectangular shape with a forming plate 6 and an anvil 7. The formed staple is pushed into a bundle of copying papers 9 by means of a driver 8. The forming plate forms opposite ends of the staple to obtain the one side-opened rectangular shape, and the anvil 7 supports a middle portion of the staple. Leg portions, which are penetrated through copying papers 9 by means of the driver 8, are bent with a clincher 10, thereby binding the papers.

This cartridge 4 is detachably received in a frame-shaped magazine 11 having an enclosing shape, and the magazine 11 is fixed to a chassis of a stacker by way of example such that the clincher 10 is vertically movable. The forming plate 6 and the driver 8 are arranged above a front edge of staple sheet 3 as viewed in its feeding direction in the magazine 11, and the forming plate and the driver are vertically movable by a driving unit. The driving mechanism for the forming plate 6 and the driver 8 involves a motor and a cam mechanism.

When a given number of copying papers 9 are fed to a given location above the clincher 10, the above driving mechanism descends the forming plate 6 and the driver 8, the clincher 10 moves up, and the copying papers 9 are placed firmly between the clincher and the magazine 11, the papers are bound with the staple 2.

The electric stapler 1 is equipped with a contact-type staple sensor not shown for detecting, through contacting any staple 3 at the tip edge in the feeding direction of the staple sheet 3, whether a front edge of the staple sheet 2 is fed to a passage for the driver.

The staple sensor is located at a side of the driver 8 in which the forming plate 6 and the driver 8 are arranged and at a location opposite to the cartridge 4, so that the staple sensor may perform rocking motions as "lever". One end of the staple sensor extends to a side of the anvil 7, and the other end to the opposite side of the cartridge 4. The staple sensor has a rocking fulcrum to rock the sensor toward the driver 8.

The staple sensor extends to contact the tip edge portion of the staple sheet 2 while crossing a locus drawn when the forming plate 6 and the driver 8 descend. The rocking fulcrum of the staple sensor is arranged above the driving mechanism so that the staple sensor may avoid the forming plate 6 and the driver 8 when the latter descend.

In the conventional electric stapler, when the leading staple is discharged, and a new one staple of the staple sheet 2 is fed, At that time, a butting end of the staple sensor 13 which is press urged against the front edge of the staple sheet 2 is rocked by one staple.

However, since the butting end of the staple sensor 13 is away from the rocking fulcrum of the staple sensor, a rocking angle is small. Therefore, the other end of the staple sensor 13 does not move over a distance sufficient enough to switch a signal for a not shown photointerruptor opposed to the sensor with the result that an erroneous signal may be generated.

Under the circumstances, when the above problem is coped with by varying a lever ratio between the one end and the other end through enlarging the distance from the fulcrum to the other end of the staple sensor 13, the entire stapler becomes bulky to deteriorate attachability of the stapler to a copying machine.

Further, every time when the forming plate 6 or the driver 8 vertically moves, the staple sensor contacts the front edge of the stapler. Consequently, there are problems that not only the detection accuracy but also the durability of the staple sensor 13 itself drop.

DISCLOSURE OF THE INVENTION

According to the staple-detecting mechanism for the electric stapler of the present invention, which has been accomplished in view of the above problems, a mechanism for detecting a front edge of a staple sheet is made smaller with enhanced detecting accuracy and improved durability.

In order to solve the above problems, a staple sheet-detecting mechanism of an electric stapler as set forth in claim 1 relates to a staple sheet-detecting mechanism of an electric stapler, which detects whether a staple sheet is positioned in a feeding passage for the staple sheet when a forming plate which is adapted to form staples of the staple sheet in a one side-opened rectangular form and a driver which is adapted to penetrate the staple formed in the one side-opened rectangular shape into copy papers are arranged above a tip edge of the feeding passage in a feeding direction of the staple sheet while directed to a direction orthogonal to the feeding passage and are moved relative to said feeding passage, and the detecting mechanism is characterized in that a rocking member is arranged above the tip edge of said feed passage, one end of the rocking member being adapted to push the tip edge of the staple sheet in the feeding direction and the other end thereof being adapted to turn on or off a detecting element, a rocking fulcrum of the rocking member is located biased to a side of the feeding passage than a side of the detecting element, and the forming plate and the driver are formed with escape depressions, respectively, so as to avoid interference against the rocking member.

BEST MODE FOR CARRYING OUT EMBODIMENT

In the following, one embodiment of the staple sheet-detecting mechanism of the electric stapler according to the present invention will be explained with reference to the drawings.

Figure 1:
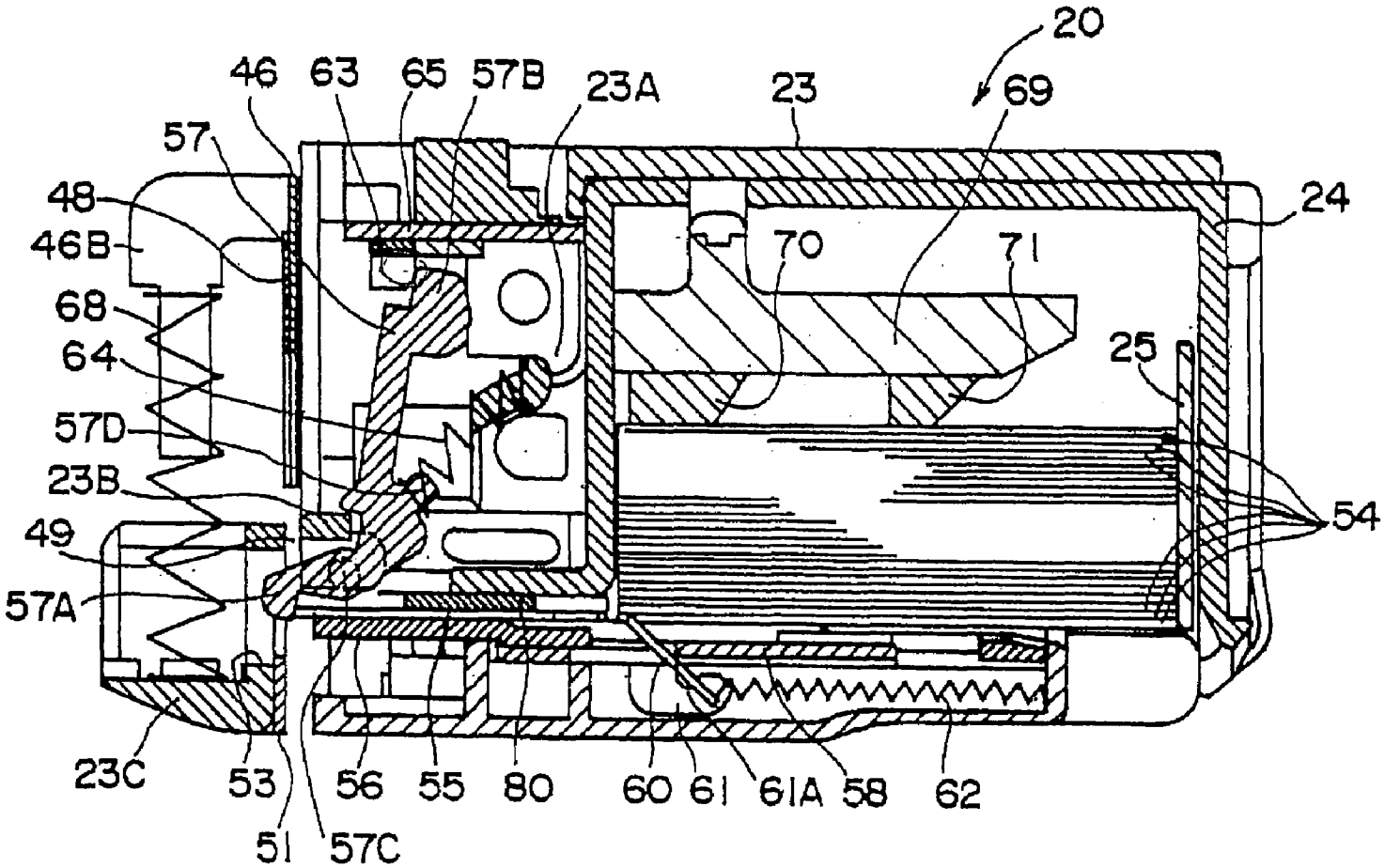
FIG. 1 is a view structurally showing in section a magazine and a cartridge casing of an electric stapler according to one embodiment of the present invention.
Figure 2:
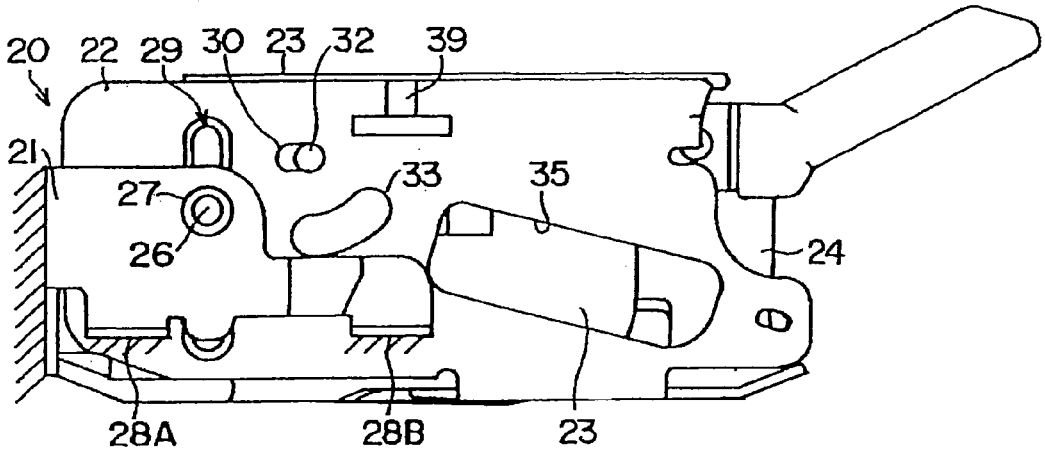
FIG. 2 is a side view of the electric stapler in FIG. 1.

FIG. 2 shows an outlined construction of the electric stapler according to one embodiment. In FIG. 2, a reference numeral 20 shows an electric stapler. The electric stapler 20 comprises an outer casing 21 fixedly attached to a frame of a stacking mechanism of a copying machine, an inner casing 22 vertically movably supported by the outer casing 21, a magazine 23 swingably held in the inner casing 22, a cartridge casing 24 fitted into the magazine 23, and a cartridge 25 (See FIG. 1) received in the cartridge casing 24.

Figure 3:
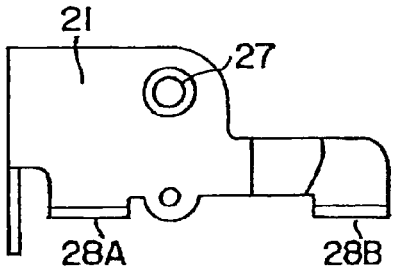
FIG. 3 is a side view of an outer casing of FIG. 1.
Figure 9:
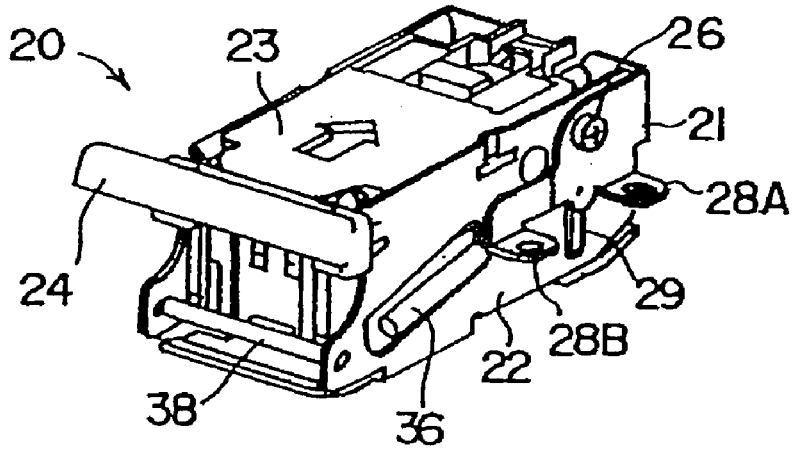
FIG. 9 is a perspective view showing a state that the magazine inclined as shown in FIG. 8 is made horizontal in conformity with the inner casing.

The outer casing 21 has a one side-opened rectangular planar shape to house the inner casing 22. As shown in FIGS. 3 and 9, a side plate of the outer casing 21 is provided with a fitting hole 27 for a guide pine 26. The outer casing 21 has projecting pieces 28A and 28B projecting outwardly. Each of the projection pieces 28A and 28B is provided with a screwing hole.

Figure 4:
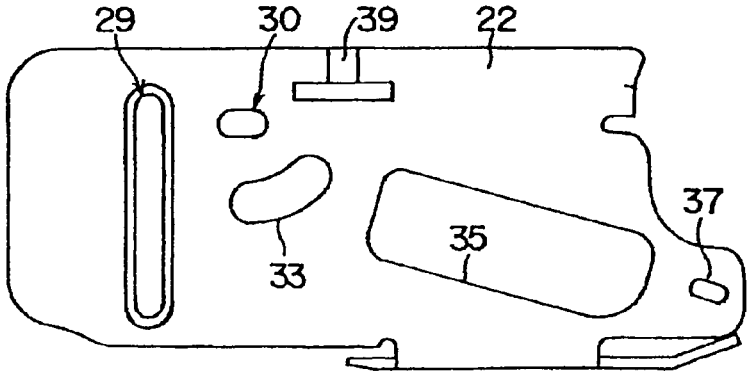
FIG. 4 is a side view of an inner casing of FIG. 1.
Figure 7:
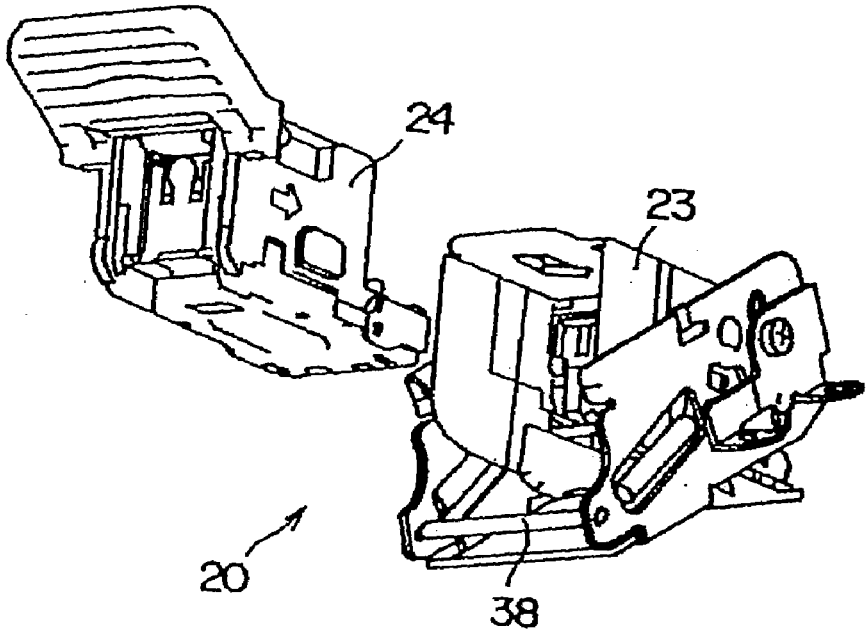
FIG. 7 is a perspective view showing a state that the inner casing is inclined immediately before the cartridge casing is inserted into the magazine.
Figure 8:
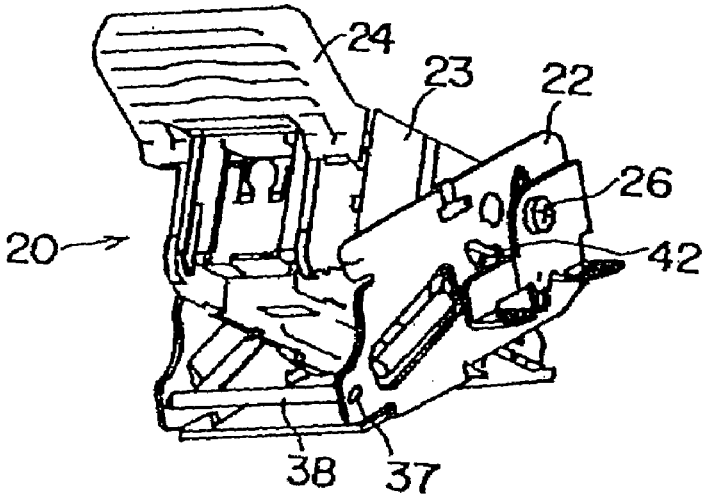
FIG. 8 is a perspective view showing a state that the cartridge casing is fitted in the magazine.

FIG. 4 shows a side shape of the inner casing 22. As is the same with the outer casing 21, the inner casing 22 is made of a plate member having a one side-opened rectangular shape, and its side plate is formed with a guide slot 29 into which the guide pin 26 is to be inserted. A reference numeral 30 donates a hole for guiding a pin 32 to rock a link 31 (See FIG. 10), and a reference numeral 33 denotes a hole for allowing movement of a pin 42 when the magazine 23 is tilted (See FIG. 8). A reference numeral 35 denotes a hole in which a spring 36 (See FIG. 9) is arranged to urge the cartridge casing 24 into a deep position of the magazine 23. A reference numeral 37 denotes a hole through which is passed a stationary shaft 38 at which one end of the spring 36 is fixed (See FIGS. 7 and 8). The stationary shaft 38 fixed with the spring 36 is engaged with a projection 34 at a rear end portion of the cartridge casing 24 to urge the magazine casing 24 into a deep portion of the magazine 23. A reference numeral 39 is a projection inwardly projecting to restrain a rocking range of the link 31.

Figure 5:
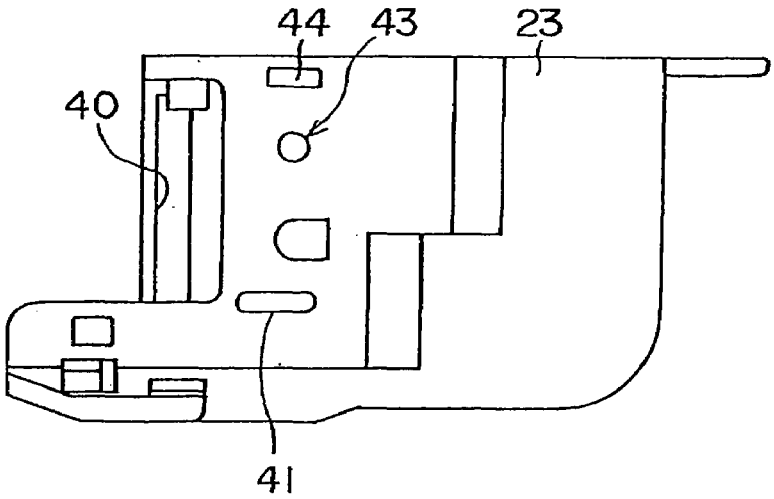
FIG. 5 is a side view of a magazine of FIG. 1

FIG. 5 is a side shape of the magazine 23. The magazine 23 has an enclosing form having a rectangular form to hold the cartridge casing 24. A guide channel 40 is formed near a front end portion of the magazine 23, corresponding to the guide channel 29. The guide pine 26 is vertically movably inserted into the guide channel 40. A reference numeral 41 denotes a hole through which is passed a shaft 42 for operating a feed claw of the cartridge casing 24 (See FIGS. 10 and 11), and a reference numeral 43 denotes a hole through which the pin 32 is passed. A reference numeral 44 denotes a projection to restrain rocking of the link 31.

A front-wall portion 45 (see FIGS. 1, 10 and 11) of the magazine 23 is formed with a guide groove 47 for guiding vertical movement of a forming plate 46. A front end portion of the magazine 23 is formed with a passage 49 for guiding the forming plate 46 and a driver 48. A vertical wall portion is formed at a further front end portion of the passage 49, and the vertical wall portion 50 is formed with a hole 53 through which is passed a projection 52 of a cover 51 of the cartridge casing 24.

Figure 6:
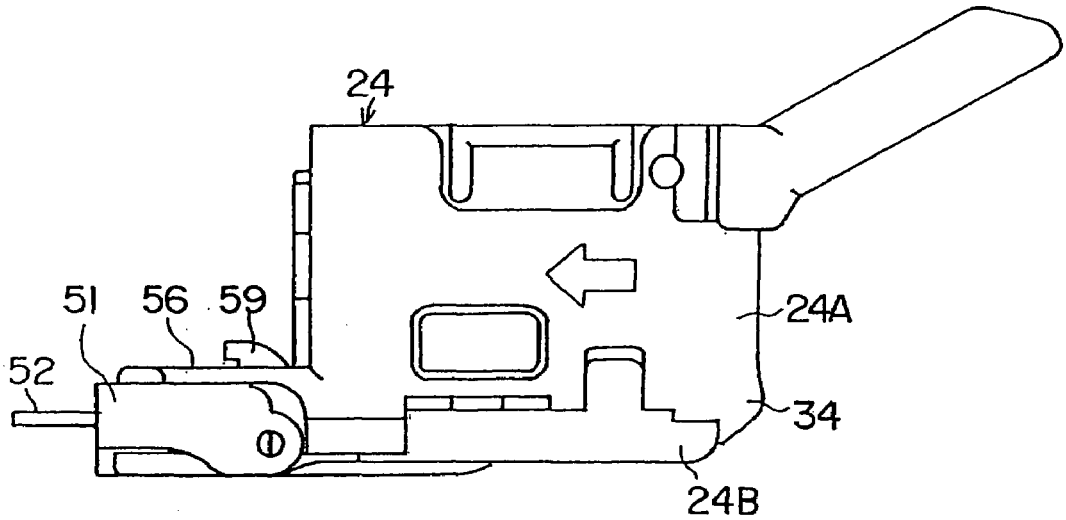
FIG. 6 is a side view of the cartridge casing of FIG. 1.

FIG. 6 shows a side shape of the cartridge casing 24. The cartridge casing 24 is constituted by an outer-layer casing 24A and a base portion 24B. The cartridge casing has such a box-shaped form with an opened bottom that the outer-layer casing 24A covers an upper portion of the cartridge 24, and a lower portion of the cartridge 25 (see FIG. 1) is supported by the base portion 24B.

As shown in FIG. 1, a passage 55 to pass a staple sheet 54 is formed between the outer-layer casing 24A and the base portion 24*b* at a side of the cover 51. A sensor 57 is arranged at an upper portion of a passage-forming portion 56 to constitute the passage 55 of the cartridge casing 24. The sensor 57 functions as a rocking member to contact a staple located at a front edge portion of the staple sheet 54 as viewed in a feeding direction.

The passage 55, which functions as a staple feeding path, is formed between a lower plate 56 held by the base portion 24B and an upper plate 80. A reference numeral 58 denotes a plate which is positioned under the lower plate 56 and slides to-and-fro. Hooks 59 are formed at right and left side ends of a front edge portion (See FIG. 6), and a feed claw 60 for a staple sheet 54 is held in a central portion of the plate 58. The feed claw 60 has rectangular projections at right and left sides, which are held by depressions 61A of a holding projection 61. The feed claw 60 is urged by a spring 62 in the feeding direction of the staple sheet 54, while the plate 58 is urged in a direction reverse to the feeding direction of the staple sheet 54 through the hook 59 being pushed by the shaft 42.

Figure 10:
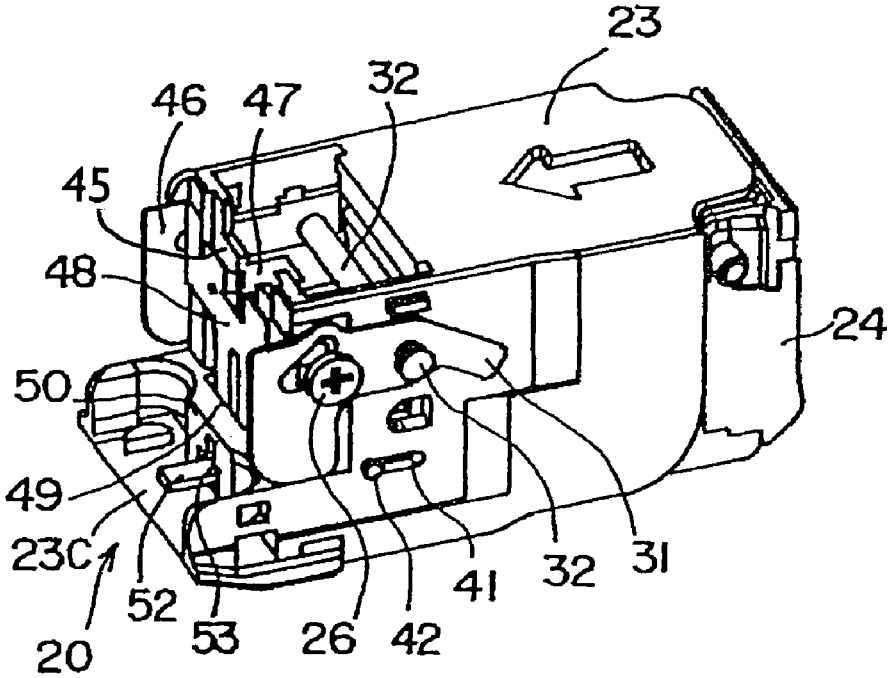
FIG. 10 is a perspective view of the electric stapler in a waiting state that an upper edge of the magazine of FIG. 1 is approached to a guide pin, and a forming plate and a driver are located in a location spaced away from passage for a staple sheet.
Figure 11:
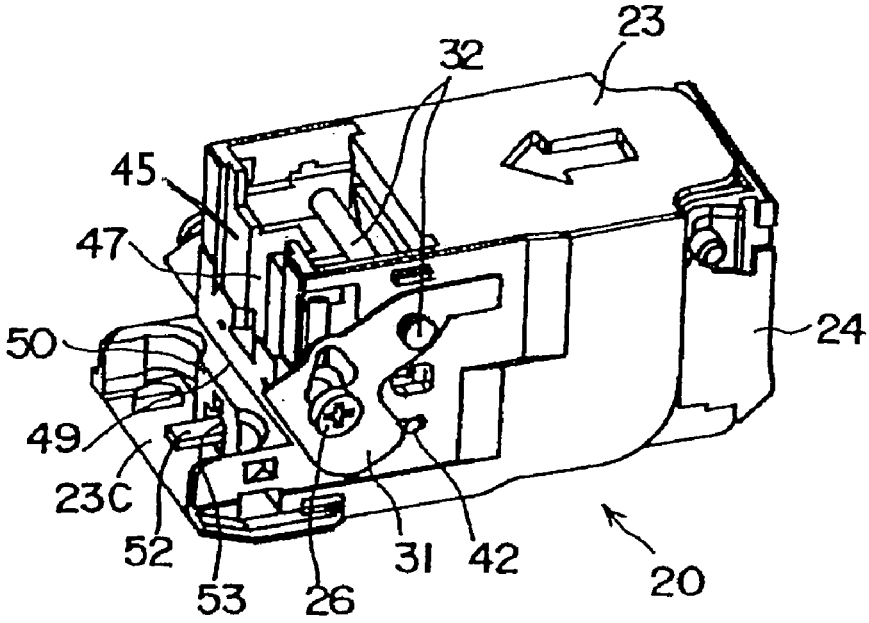
FIG. 11 is a perspective view of the electric stapler in a state that the upper edge of the magazine of FIG. 1 is spaced from the guide pin, and the forming plate and the driver are located in the passage of the staple sheet.

As shown in FIG. 11, the shaft 42 is pushed by the link 31 and moved in a direction to compress the spring 62 when the pin 32 rises relative to the guide pin 26 to rock the link 31. Consequently, the hook 59 retreats to move back the plate 58. The back movement of the plate 58 makes the feed claw 60 mesh with a depression bridging succeeding staples. As shown in FIG. 10, as the pin 32 descends relatively toward a side of the guide pin 26, the link 31 is released from pushing the shaft 42. On the other hand, the plate 58 is moved toward a side of an outlet of the passage 55 owing to an elastic force of the spring 62, and the feed claw 60 feeds forward only one staple of the staple sheet 54.

The sensor 57 contacts the staple located at a tip edge of the staple sheet 54 fed out, and detects whether the staple sheet 54 is present or not. That is, one end portion 57A of the sensor 57 faces an end portion of the passage 55 at the outlet side to which the staple sheet 54 is fed, while the other end 57B of the sensor 57 extends to pass through a transmission type interrupter 63. A rocking fulcrum 57C of the sensor 57 is located biased to the passage 55 than the interrupter (detecting element) 63. The distance from the rocking fulcrum 57C to the other end 57B of the sensor 57 is longer than that from the rocking fulcrum 57C to one end 57A of the sensor 57.

That is, since the staple sheet 54 is fed by around one staple, a length of an arc drawn by one end 57A of the sensor 57 during rocking is very small. The rocking fulcrum 57C is biased toward the side of one end 57A, and the length between the rocking fulcrum 57C and the other end 57B is around 4 to 6 times as large as that between the rocking fulcrum 57C and one end 57A.

Accordingly, even when the staple sheet 54 is fed by the distance corresponding to one staple, the length of the arch drawn by the other end 57B of the sensor 57 during rocking, which is equivalent to 4 to 6 staples, can be realized. Thereby, the other end 57B can be assuredly moved in a distance sufficient enough to turn on or off the interrupter 63, so that it is possible to accurately detect whether the staple sheet 54 is fed or not.

One end 57A of the sensor 57 contacts the staple located at a tip edge of the staple sheet 54 when the tip edge of the staple sheet 54 is located immediately under the forming plate 46. On the other hand, the other end 57B of the sensor 57 makes the interrupter 63 conductive. When the tip edge portion of the stapler sheet 54 is not fed to immediately under the forming plate 46, a projection near the rocking fulcrum 57C butts against a front wall portion 23B of the magazine 23 to stop rocking, so that the other end 57B of the sensor 57 hinders light transmission of the interrupter 63 to make it non-conductive.

The rocking fulcrum 57C is formed by a shaft 57E projecting to right and left sides of the sensor 57 (See FIG. 13), and held at depressions formed in right and left inner faces of a base portion of the magazine 23.

To a projection 57D at an intermediate portion of the sensor 57 is fitted one end of the spring 64, which is supported by a partition wall 23A of the magazine at other end, and the spring 64 urges one end 57A of the sensor 57 in a direction reverse to the feeding direction of the staple sheet 54.

Figure 12:
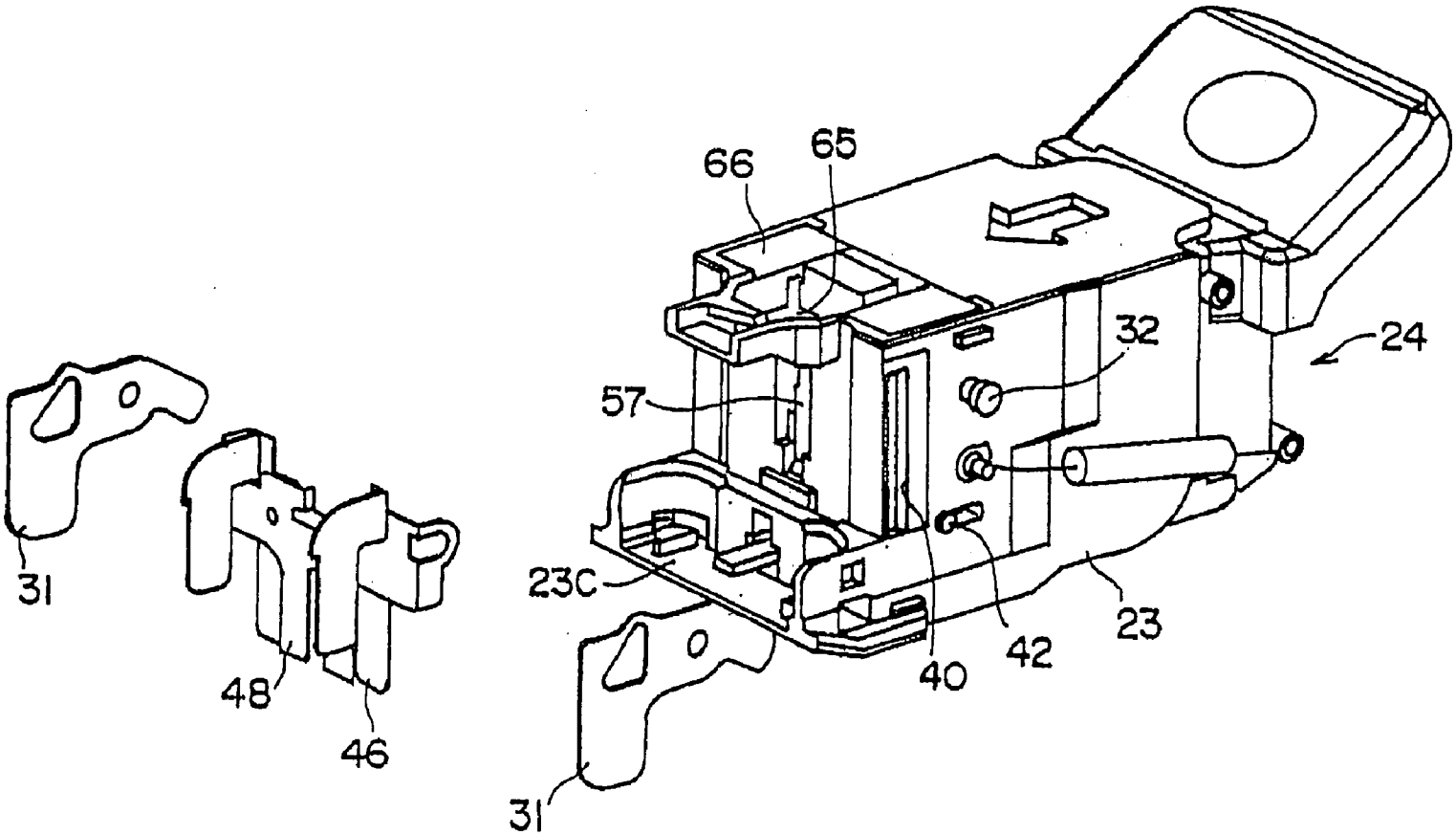
FIG. 12 is a perspective view of the electric stapler showing a state where the forming plate, the driver and a link are combined together.
Figure 15:
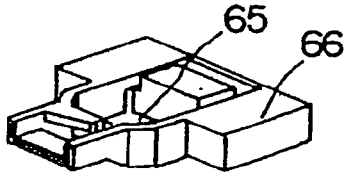
FIG. 15 is a perspective view of a holder for attachment of a substrate to be arranged above the passage of the magazine.
Figure 16:
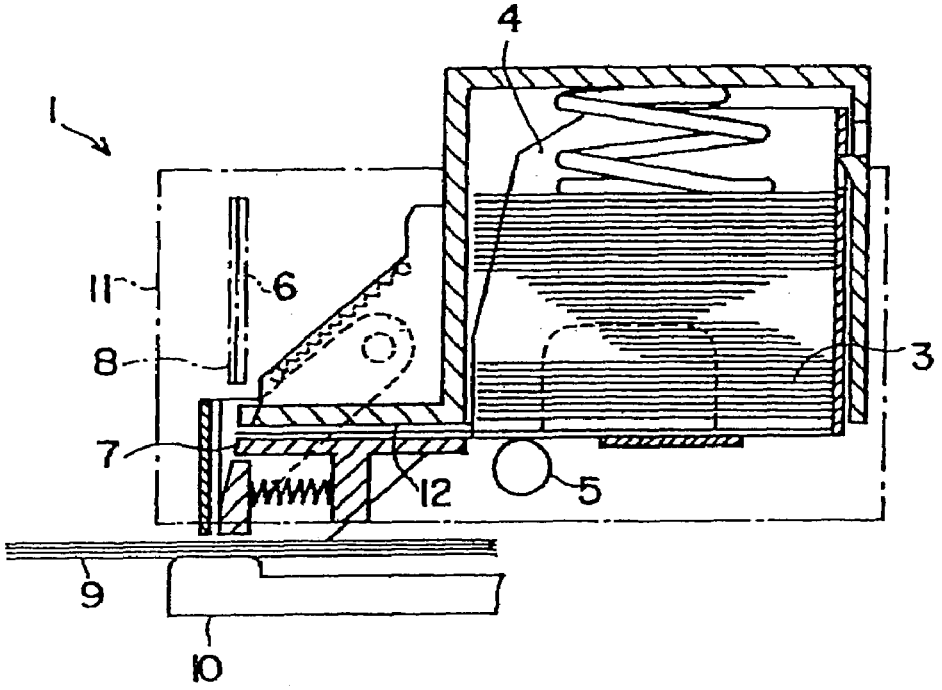
FIG.16 Prior Art
FIG. 16 is a sectional view of the conventional cartridge casing.
Figure 17:
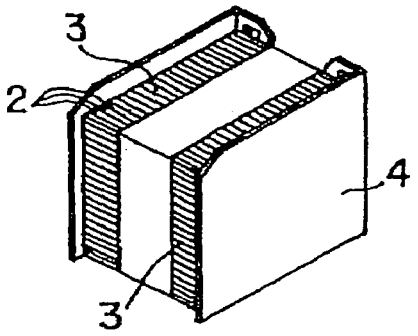
FIG.17 Prior Art
FIG. 17 is a perspective view of the conventional cartridge.
Figure 18:
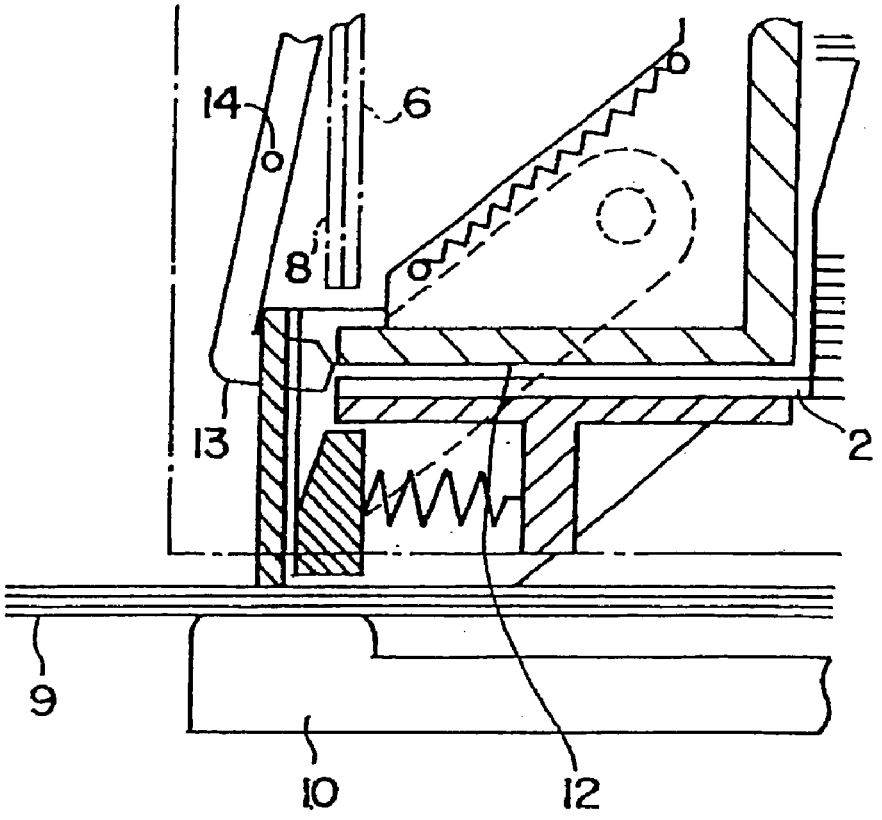
Prior Art FIG.18
FIG. 18 is an enlarged view showing the positional relationship between the staple sensor and the staple.

The interrupter 63 is attached to a rear face of a base plate 65 shown in FIGS. 12 and 15. The base plate 65 is supported by a holder 66. The base plate 65 is attached with other sensor switch, etc. than the interrupter 63. Based on output signals from the interrupter 63, the other sensor switch, etc., a copying machine judges whether the electric stapler 20 is in a waiting state, an operation state or an erroneous state.

Figure 13:
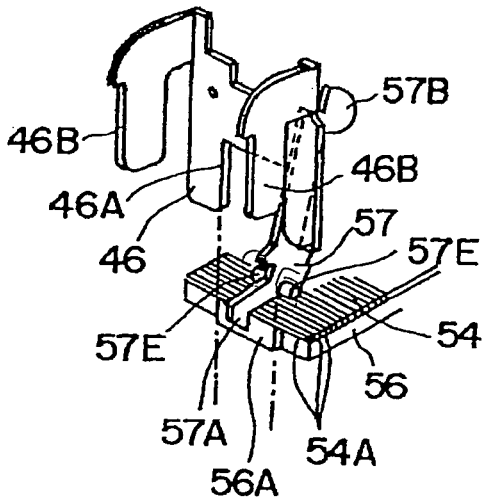
FIG. 13 is a perspective view showing positional relationship among the forming plate, the sensor and the staple sheet.
Figure 14:
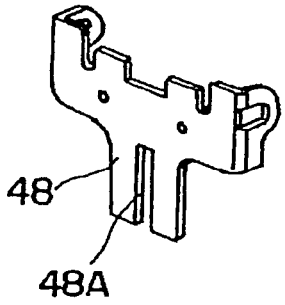
FIG. 14 is a perspective view of the driver.

As mentioned above, the forming plate 46 and the driver 48 are arranged immediately above one end 57A of the sensor 57. FIG. 12 shows a state in which the forming plate 46 is combined with the driver 48. As shown in FIG. 13, the forming plate 46 is formed with a one side-opened rectangular forming depression 46A in a lower end central portion, and a pair of reverse J-letter shaped projections 46B are formed at opposite sides of an upper end portion. As shown in FIG. 12, the driver 48 is assembled to a lower side of the projections 46B.

The lower end portion of the forming plate 46 forms a staple in a one side-opened rectangular shape in cooperation with the anvil 56A. The depression 46A of the forming plate 46 has such a depth that one end portion 57A of the sensor 57 may be located inside the depression 46A even when the forming plate 46 most approaches the anvil 56A.

The lower end of the driver 48 is made flat so that when it descends together with the forming plate 46, the staple formed in the one side-opened rectangular shape is penetrated through a bundle of copying papers. The lower end central portion of the driver 48 is formed with an escape depression 48A for locating one end 57A of the sensor 57. The escape depression 48A of the driver 48 has such a depth that when the staple is penetrated through a bundle of the copying papers and leg portions projecting toward a rear side of the copying papers are bent by a clincher not shown, one end 57A of the sensor 57 may be located in the escape depression.

A spring 68 is fitted between the projections 46B of the forming plate 46 and a horizontal portion 23C of the magazine 23 at a front side, and the forming plate 46 and the driver are urged by the spring 68 in such a direction that the forming plate 46 and the driver 48 may be spaced away from the horizontal portion 23C of the magazine 23.

The cartridge 25 housed inside the cartridge casing 24 is pushed downwardly by projections 70 and 71 of a push plate 69.

As mentioned above, the electric stapler 20 of this embodiment is provided with the passage 55 for feeding, in a direction orthogonal to the staples, the staple sheet 54 which is formed by arranging the straight forward staples parallel to one another and bonding them in a sheet-like form, and the forming plate 46 which forms the staple in the one side-opened rectangular shape and the driver 48 which pushes the one side-opened rectangular staple into the copying papers are arranged against the anvil 56A in the feeding direction of the staple sheet 54 through the passage 55. The forming plate 46 and the driver 48 are moved across the staple 54A, so that the formed staple is pushed into the copying papers located under the passage 55.

The sensor (rocking member) 57 is located above the anvil 56A in the passage 55 and in a place where the forming plate 46 waits immediately before the forming step in such a manner that one end 57A contacts the staple at the tip edge of the stapler sheet 54 in the feeding direction and the other end 57B turns on or off the interrupter (detecting element) 63.

Further, it is characterized that the rocking fulcrum 57C of the sensor 57 is located biased to the side of the staple sheet 54 in the passage 55, and the forming plate 46 and the driver 48 are provided with the depressions (openings) 46A and 48A, respectively, for allowing one end 57 of the sensor 57 to rock.

According to the staple sheet-detecting mechanism of the electric stapler of the present invention, since the rocking fulcrum of the rocking member is located at a place on the side of the staple sheet-contacting position and remote from the detecting element, the rocking angle of the other end during rocking becomes larger. Thus, since the detecting element can be clearly turned on or off, the detecting accuracy is enhanced. Further, even when the "lever" ratio is large, the detecting mechanism can be made smaller by the above construction, thereby miniaturizing the stapler, too.

Furthermore, since the forming plate and the driver are provided with the openings, respectively, to allow the rocking member to rocking, the rocking member is prevented from being worn through contacting them. Thus, durability is enhanced.

According to such a staple sheet-detecting mechanism of the electric stapler 20, since the rocking fulcrum 57 of the sensor 57 is located at a position nearer to the passage 55 through which the staple sheet 54 is fed, the length of the arc drawn by the other end 57B is larger, so that the interrupter 63 can be clearly turned on or off to improve the detecting accuracy.

In addition, since the forming plate 46 and the driver 48 are provided with the depressions 46A and 48A, respectively to allow the sensor to rocking, the sensor 57 can be prevented from being worn through contacting the forming plate 46 and the diver 48, and the durability of the sensor can be enhanced. And, since the sensor 54 is arranged nearer to the forming plate 46 and the driver 48 and on the side of the cartridge 25, the miniaturization of the stapler can be promoted.

What is claimed is:

1. A staple sheet-detecting mechanism of an electric stapler, comprising:

a detecting element for detecting whether a staple sheet is positioned in a feeding passage when a forming plate and a driver are moved relative to said feeding passage, and a rocking member arranged above a tip edge of said feeding passage in a feeding direction of the staple sheet, a first end of the rocking member being configured to contact the tip edge of the staple sheet in the feeding direction, and a second end of the rocking member being configured to turn on or off said detecting element, the forming plate and the driver being arranged directed to a direction orthogonal to the feeding passage, said forming plate being configured to form staples of the staple sheet in a one side-opened rectangular form and said driver being configured to penetrate the staple formed in a one side-opened rectangular shape into copy papers, wherein a rocking fulcrum of the rocking member is located nearer to a side of the feeding passage than to a side of the detecting element, the rocking member and the detecting element are arranged substantially between said driver and a cartridge and above said feeding passage, and each of the forming plate and the driver is formed with a slot, so as to avoid interference against the rocking member.

2. The staple sheet-detecting mechanism of the electric stapler according to claim 1, wherein said first end of the rocking member constantly pushes the tip edge of the staple sheet in the feeding direction of the staple sheet.

3. The staple sheet-detecting mechanism of the electric stapler according to claim 1, wherein a distance from a rocking fulcrum of the rocking member to the second end of the rocking member is 4 to 6 times as large as that from the fulcrum to said first end of the rocking member.

* * * * *